US008077005B2

(12) United States Patent
Okura et al.

(10) Patent No.: US 8,077,005 B2
(45) Date of Patent: Dec. 13, 2011

(54) ALIGNED MULTILAYER WOUND COIL

(75) Inventors: Noriyoshi Okura, Wako (JP); Akihiro Sakashita, Wako (JP)

(73) Assignee: Okayama Giken Co., Ltd., Wako-shi, Saitama (JP)

( * ) Notice: Subject to any disclaimer, the term of this patent is extended or adjusted under 35 U.S.C. 154(b) by 0 days.

(21) Appl. No.: 12/450,758

(22) PCT Filed: Feb. 26, 2008

(86) PCT No.: PCT/JP2008/000346
§ 371 (c)(1),
(2), (4) Date: Oct. 9, 2009

(87) PCT Pub. No.: WO2008/129756
PCT Pub. Date: Oct. 30, 2008

(65) Prior Publication Data

US 2010/0102913 A1 Apr. 29, 2010

(30) Foreign Application Priority Data

Apr. 12, 2007 (JP) ..... 2007-104457
Sep. 6, 2007 (JP) ..... 2007-231916

(51) Int. Cl.
*H01F 27/28* (2006.01)
*H01F 27/32* (2006.01)
*H01F 29/00* (2006.01)

(52) U.S. Cl. ..... 336/186; 336/69; 336/84 R; 336/70

(58) Field of Classification Search ..... 336/84 R, 336/69–70, 187, 186
See application file for complete search history.

(56) References Cited

U.S. PATENT DOCUMENTS 4,454,492 A * 6/1984 Thackray ..... 336/69
6,888,436 B1 * 5/2005 Yagasaki ..... 336/84 C
7,148,779 B2 * 12/2006 Wolfgram ..... 336/70
2005/0012584 A1 * 1/2005 Park ..... 336/182
2006/0049903 A1 * 3/2006 Wolfgram ..... 336/180

FOREIGN PATENT DOCUMENTS

JP 10-256054 9/1998
JP 2000-277358 10/2000
JP 2006-245298 9/2006

OTHER PUBLICATIONS

Notification of Transmittal of Translation of the International Preliminary Report on Patentability; International Preliminary Report on Patentability; Written Opinion of the International Searching Authority for corresponding PCT Application No. PCT/JP2008/000346.

* cited by examiner

*Primary Examiner* — Anh Mai
(74) *Attorney, Agent, or Firm* — Flynn, Thiel, Boutell & Tanis, P.C.

(57) ABSTRACT

The invention provides an aligned multilayer wound coil that is compact in size and excellent in productivity, an apparatus for manufacturing the same, an electrical equipment and a non-inductive resistance to which the aligned multilayer wound coil is applied. The aligned multilayer-wound coil comprises two or more winding layers, the winding layers being provided with insulated electric wires, respectively, wound in one direction in alignment with each other, wherein a lead wire is guided out from respective ends of the coil, on a layer-by-layer basis, and wherein the lead wire guided out from one end of the coil on a layer-by-layer basis is connected to one terminal while the lead wire guided out from the other end of the coil on a layer-by-layer basis is connected to the other terminal, and winding layer coils on a layer-by-layer basis are connected in parallel with each other in a circuit.

4 Claims, 11 Drawing Sheets

ALIGNED MULTILAYER WOUND COIL

TECHNICAL FIELD

The present invention relates to an aligned multilayer wound coil comprising not less than two winding layers, the winding layers having insulated electric wires, respectively, so as to be wound around in alignment, an apparatus for manufacturing the aligned multilayer wound coil, an electrical equipment and a non-inductive resistance, with the aligned multilayer wound coil applied thereto.

BACKGROUND TECHNOLOGY

A large number of coils, each thereof generally called a magnet wire, formed by winding an insulated electric wire, have thus far been used in a variety of electrical equipment. Those coils are for various applications including use in a transformer for generating a high voltage. For the generation of a high voltage, the number of windings on the secondary winding side of a transformer is increased. If a high potential difference occurs between adjacent insulated electric wires within the secondary wiring, the potential difference will exceed a dielectric breakdown voltage to thereby cause short circuiting, the so-called rare short, thereby damaging the equipment.

In order to avoid such an event, a winding frame 500 was partitioned into a number of parts with an insulator interposed therebetween in the past such that sidewalls 510, and intermediate walls 520 are provided by stages, increasing the number of the intermediate walls 520 according to an application voltage, as shown in FIG. 13, thereby applying partial winding to the winding frame 500 with an insulated electric wire 540. However, since the winding frame 500 was separated by the insulator, it was difficult to achieve reduction in size, resulting in a high cost. That is, the coil became larger in volume, and was unsuitable for equipment of which miniaturization is required. Furthermore, for use in a HID (High Intensity Discharge Lamp), the demand for which is increasing because it is high in directivity and is capable of brightly and clearly illuminating a target away at a distance, the coil needs to have a large conductor cross sectional area since a high voltage temporarily occurs upon the lighting of a HID, and a large current flows after the lighting while miniaturization is required, so that a flat type electric wire has been often used. The flat-type electric wire, however, has had problems of a high cost and poor workability.

Further, in order to use a coil as the voice coil of a speaker, there is the need for holding back the inductance to thereby cause a large current to flow through a narrow space, so that the flat-type electric wire is often used for the voice coil of a high-end speaker.

Some of those coils are directly mounted on a printed circuit board depending on the applications. In such a case, with a coil used for a power supply circuit and so forth, there is the need for holding back the inductance of the coil, thereby causing a large current to flow through a narrow space, so that there have been many cases where the flat-type electric wire is used in those coils.

However, the flat-type electric wire, being a special item, has had a problem in that it lacks in marketability, is expensive, and its workability is poor. Furthermore, there has been available a method for concurrently winding two lengths of wires as bifilar winding, but this has had a problem of two lengths of wires getting entangled, requiring some special ideas.

There is proposed a multilayer coil, as a related prior art, for preventing wires from swelling in the direction of a core outer diameter in a face wherein the wire wires of an upper layer and those on the lower layer intersect by feeding the wires when two or more wire rods are wound in alignment on the core in parallel with each other (see, for example, patent document 1). However, this has a problem in that it needs a dedicated specific apparatus.

Patent Document: JP 2006-245298A

DISCLOSURE OF THE INVENTION

Problems to be Solved by the Invention

The invention has been developed in order to solve the problems described above, and it is an object of the invention to provide an aligned multilayer wound coil that is compact in size and excellent in productivity, an apparatus for manufacturing the same, an electrical equipment, and a non-inductive resistance to which the aligned multilayer wound coil is applied.

The inventors have found that either a case of connecting aligned wound coils in parallel to respective terminals or a case of connecting aligned wound coils in series to the respective terminals is properly used on a layer-by-layer basis, and have successfully completed the following invention.

(1) An aligned multilayer-wound coil comprising two or more winding layers, the winding layers being provided with insulated electric wires, respectively, wound in one direction in alignment with each other, wherein a lead wire is guided out from respective ends of the coil, on a layer-by-layer basis.

(2) The aligned multilayer-wound coil as set forth under item (1) as above, wherein the lead wire guided out from one end of the coil on a layer-by-layer basis is connected to one terminal while the lead wire guided out from the other end of the coil on a layer-by-layer basis is connected to the other terminal, and winding layer coils on a layer-by-layer basis are connected in parallel with each other in a circuit.

With the aligned multilayer-wound coil set forth under any of the items (1) to (2) as above, the insulated electric wires are wound in the one direction in alignment with each other, the lead wire is guided out from the respective ends of the coil on a layer-by-layer basis, the lead wire guided out from the one end of the coil on a layer-by-layer basis is connected to one terminal while the lead wire guided out from the other end of the coil on a layer-by-layer basis is connected to the other terminal, and the winding layer coils on a layer-by-layer basis are connected in parallel with each other in the circuit.

Accordingly, when a power source is connected to the respective ends of the coil to thereby cause a current to flow, the directions of the magnetic fields produced by the current flowing through the coils on a layer-by-layer basis are identical to each other. In consequence, this has substantially the same effect as the case of winding with a winding wire, having a cross-sectional area equivalent to a cross-sectional area obtained by multiplying a cross-sectional area of each of the winding wires wound in alignment by the number of the layers.

Further, because windings in alignment are adopted, a potential difference occurring to individual insulated electric wires being adjacent to each other, in one layer, is equivalent to a voltage obtained by dividing a voltage occurring across the parallel-connected coils by the number of windings, in one layer. Further, a voltage applied to the individual insulated electric wires adjacent to each other, between coil layers, is nearly zero in value, or is equivalent to a voltage obtained by dividing a voltage occurring between the coil layers by the number of windings in one layer. This is because the coils in each of those layers are connected in parallel with each other.

Accordingly, by use of an insulated electric wire with a coating having adequate insulation resistance, it is possible to prevent the occurrence of poor insulation such as rare short or the like. Thus, a compact aligned multilayer wound coil excellent in insulation properties, having a large current capacity, and capable of preventing poor insulation such as the rare short or the like can be obtained without the use of a specialized flat-type wire.

(3) An aligned multilayer-wound coil comprising two or more winding layers, the winding layers being provided with insulated electric wires, respectively, wound in one direction in alignment with each other, wherein aligned wound coils in respective layers are connected in series with each other in a circuit.

(4) The aligned multilayer-wound coil set forth under item (3) above, wherein the number of windings in a specific layer is adjusted in order to adjust the inductance of the aligned multilayer-wound coil.

The aligned multilayer-wound coil set forth under any of the items (3) and (4) above differs from the invention under the item (2) above in that the aligned wound coil in an odd number layer is connected in series with the aligned wound coil in an even number layer.

Accordingly, when a power source is connected to both ends of those coils to thereby cause a current to flow, the respective magnetic fields generated by the current flowing through the coils in the respective layers are opposed to each other in direction, thereby canceling each other out. Further, by adjusting the number of windings in a specific layer in order to adjust the inductance of the aligned wound coils, the inductance can be effectively reduced to as small as nearly zero. Thus, a non-inductive resistance can be provided. The specific layer is preferably the outermost layer. The reason for that is because the number of windings can be adjusted with ease in the outermost layer.

(5) An apparatus for manufacturing the aligned multilayer wound coil set forth under items (1) or (2) as above.

(6) An apparatus for manufacturing the aligned multilayer wound coil set forth under items (3) or (4) as above.

(7) An electrical equipment employing the aligned multilayer wound coil set forth under items (1) or (2) as above.

With the use of the electrical equipment employing the aligned multilayer wound coil set forth under items (1) or (2) as above, it is possible to reduce the cost as compared with the case of electrical equipment employing a coil using a flat-type electric wire, and to provide electrical equipment of equivalent quality or better. The electrical equipment is preferably a speaker or a transformer, although not limited thereto.

In the case of the electrical equipment being a speaker, with the use of the electrical equipment employing the aligned multilayer wound coil set forth under item (2) as above, as a voice coil of the speaker, it is possible to reduce the cost as compared with the case of a voice coil using a flat-type electric wire, and to provide a speaker of equivalent quality or better.

Further, with the use of the aligned multilayer wound coil set forth under item (2) above, in a transformer, it is possible to reduce the cost as compared with the case of a transformer using a flat-type electric wire, and to provide a transformer of equivalent quality or better.

(8) A non-inductive resistance employing the aligned multilayer wound coil set forth under items (3) or (4) as above.

With the use of the aligned multilayer wound coil set forth under items (3) or (4) as above for resistance, it is possible to provide a resistance having a small inductance.

(9) A winding frame for the aligned multilayer wound coil set forth under any of the items (1) to (4) as above, With the use of the winding frame for the aligned multilayer wound coil, set forth under item (9) as above, together with the apparatus for manufacturing the aligned multilayer wound coil, set forth under items (5) or (6) as above, it is possible to manufacture the aligned multilayer wound coil according to the invention.

Further, the inventors have found out the availability of stacking up a plurality of disk-like coils wound in alignment in one row and connecting winding-start wires with each other, and winding-finish wires with each other, and have successfully completed the following invention.

(10) An aligned wound multilayered coil comprising a plurality of disk-like coils, the disk-like coils being wound in alignment in one row, wherein winding-start wires are connected with each other while winding-finish wires are connected with each other, and the respective coils are connected in parallel with each other.

With the aligned wound multilayered coil set forth under item (10) as above, a plurality of disk-like coils are wound in alignment in one row, wherein winding-start wires are connected with each other while winding-finish wires are connected with each other, and the respective coils are connected in parallel with each other.

Accordingly, when a power source is connected to the respective ends of the aligned multilayer wound coil to thereby cause a current to flow, the directions of the magnetic fields produced by the current flowing through the coils on a layer-by-layer basis are identical to each other. In consequence, this has substantially the same effect as that in the case of winding with a winding wire, having a cross-sectional area equivalent to a cross-sectional area obtained by multiplying a cross-sectional area of each of the winding wires wound in alignment by the number of the layers.

Further, because windings in alignment are adopted, a potential difference occurring to individual insulated electric wires being adjacent to each other in one layer, is equivalent to a voltage obtained by dividing a voltage occurring across the parallel-connected coils by the number of windings in one layer. Further, a voltage applied to the individual insulated electric wires adjacent to each other, between coil layers, is nearly zero in value, or is equivalent to a voltage obtained by dividing a voltage occurring between the coil layers by the number of windings in one layer. This is because the coils in each of those layers are connected in parallel with each other.

Accordingly, by use of an insulated electric wire with a coating having an adequate insulation resistance, it is possible to prevent the occurrence of poor insulation such as rare shorts or the like. Thus, a compact aligned multilayer wound coil excellent in insulation properties, having a large current capacity, and capable of preventing poor insulation, such as the rare shorts or the like, can be obtained without the use of a specialized flat-type wire.

(11) The aligned wound multilayered coil set forth under item (10) as above, wherein a flat-type wire is used for a winding wire.

With the aligned wound multilayered coil set forth under item (11) as above, flat-type wire is used for the winding wire, however, since parallel-connection without use of the flat type wire can be implemented between winding-start wires as well as winding-finish wires, it is possible to solve a problem of poor workability in a crossover region between respective winding layers, in particular, as encountered in the past. Further, for the flat type wire, use is preferably made of a ribbon wire with an insulating coating uniformly formed thereon, including corners of a conductor.

Effect of the Invention

With the present invention, it is possible to provide a compact aligned multilayer wound coil excellent in electrical safety, having a large current capacity, by use of the insulated electric wire, generally called the magnet wire, without use of a specialized flat type wire, and without causing poor insulation, such as rare short or the like.

10 insulated electric wires

111, 113 odd number layers of aligned wound coils

112, 114 even number layers of aligned wound coils

70 winding frame for the aligned multilayer wound coil

BEST MODE FOR CARRYING OUT THE INVENTION

Embodiments of the invention are described hereinafter with reference to the accompanying drawings. It is to be pointed out, however, that those are only for illustrative purposes, and that the technical scope of the invention is not limited thereto.

First Embodiment

Figure 1:
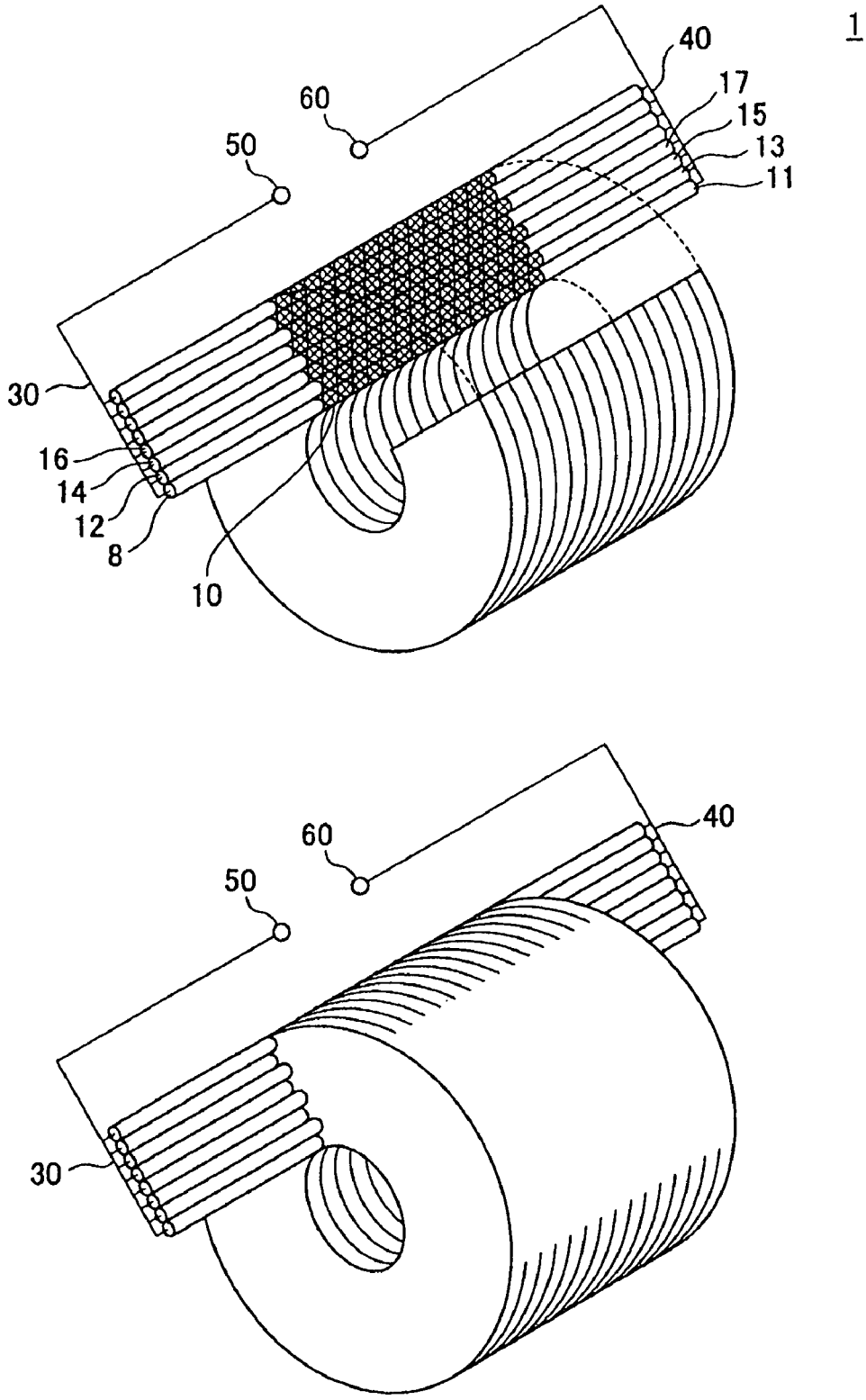
FIG. 1 is a perspective view of a parallel-connected aligned multilayer wound coil according to one embodiment of the invention.
Figure 2:
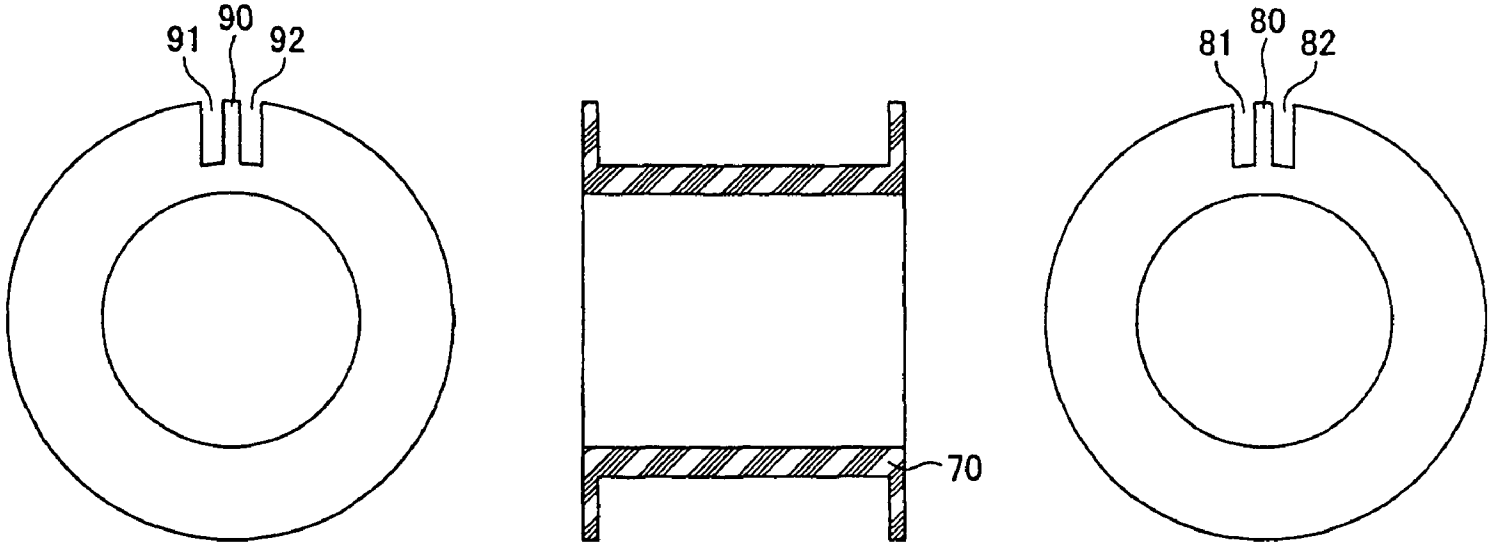
FIG. 2 is a view showing three planes of a winding frame for the aligned multilayer wound coil according to one embodiment of the invention.
Figure 3:
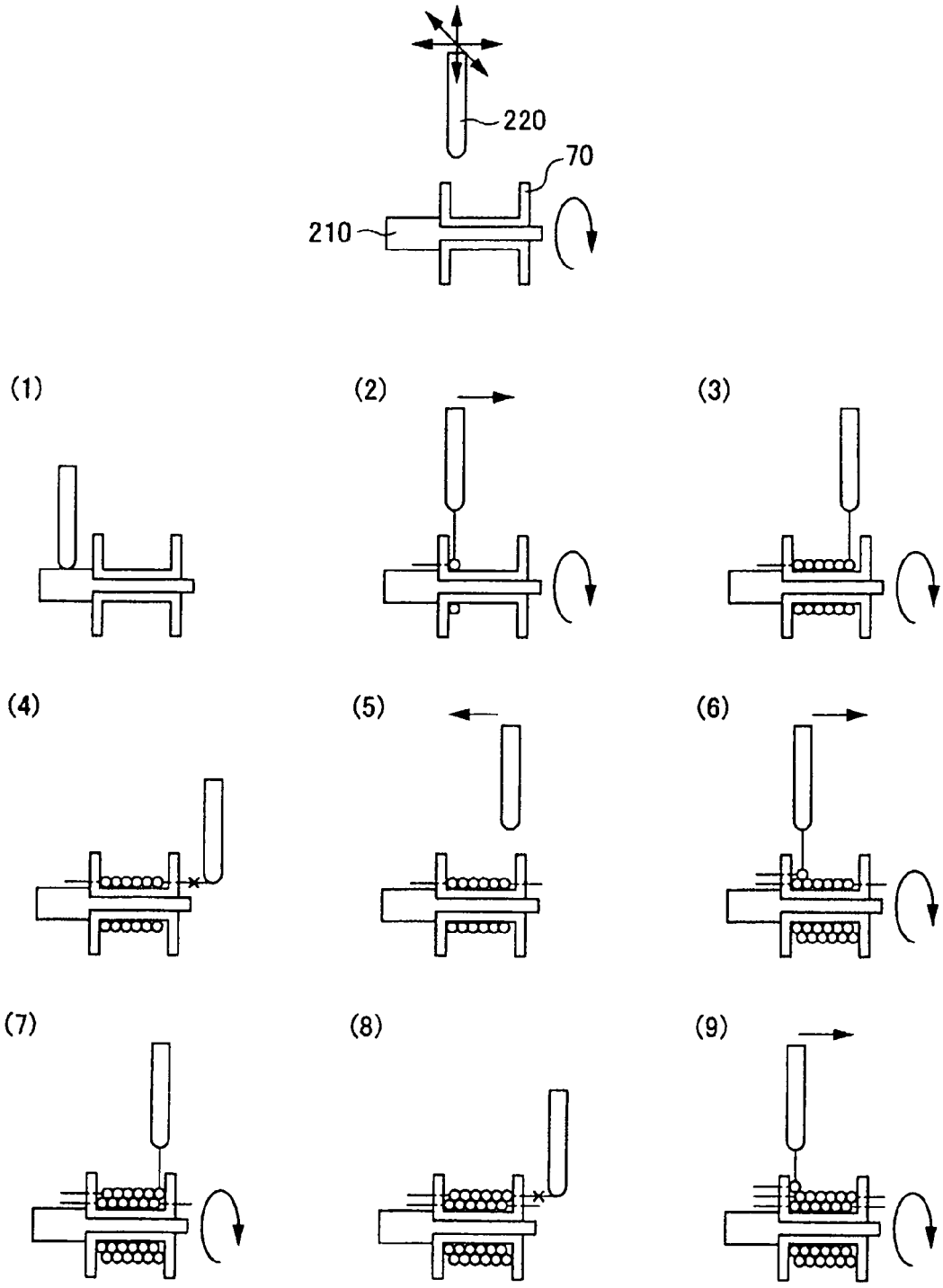
FIG. 3 is a conceptual view showing operation of an apparatus for manufacturing the aligned multilayer wound coil according to one embodiment of the invention.

A first embodiment of the invention is concerned with a parallel-connected aligned multilayer wound coil. FIG. 1 is a perspective view of the parallel-connected aligned multilayer wound coil according to the first embodiment of the invention. FIG. 2 is a view showing three planes of a winding frame for the aligned multilayer wound coil according to one embodiment of the invention. FIG. 3 is a conceptual view showing operation of an apparatus for manufacturing the aligned multilayer wound coil.

As shown in FIG. 1, the parallel-connected aligned multilayer wound coil 1 according to the invention is an aligned multilayer wound coil comprising two or more winding layers, the winding layers being provided with insulated electric wires 10, respectively wound in alignment with each other, and there are guided out lead wires 8, 12, 14, 16, . . . , at one end of the coil, and lead wires 11, 13, 15, 17, . . . , at the other end of the coil, on a layer-by-layer basis. The lead wires guided out from the respective ends of the coil, in every layer, are connected with each other at respective ends (30, 40), as shown in FIG. 1, for connection with terminals 50, 60, respectively.

The parallel-connected aligned multilayer wound coil 1 can be manufactured by winding the insulated electric wires 10, which are circular in cross-section, on the winding frame 70 for the aligned multilayer wound coil, as shown in FIG. 2. A sidewall on one side of the winding frame 70 for the aligned multilayer wound coil is provided with notches 81, 82, for enabling the insulated electric wire 10 to pass therethrough, respectively, and between the notches 81, 82, there is provided a protrusion 80 for enabling the insulated electric wire 10 to be turned around it. Similarly, a sidewall on the other side of the winding frame 70 is provided with notches 91, 92, for enabling the insulated electric wire 10 to pass therethrough, respectively, and between the notches 91, 92, there is provided a protrusion 90 for enabling the insulated electric wire 10 to be turned around it, as shown in FIG. 2. If the winding frame 70 for the aligned multilayer wound coil, after winding, is put to use as a finished product, the winding frame 70 is preferably fabricated of an insulating material. Otherwise, the winding frame 70 may be fabricated of a metal instead of the insulating material to be removed out of the aligned multilayer wound coil after the completion of winding.

The winding frame 70 for the aligned multilayer wound coil is wound with the insulated electric wires 10 in alignment, as described above. A specific method for winding is described hereinafter with reference to FIG. 3. An apparatus 200 for manufacturing the aligned multilayer wound coil, according to the invention, comprises a driver (not shown) capable of rotating a spindle 210, a controller (not shown), and a guide 220 for use in feeding of the insulated electric wires 10.

The winding frame 70 for the aligned multilayer wound coil is set to a state shown in FIG. 3 (1) at the spindle 210, and the insulated electric wire 10 that is about to be used is set to the guide 220 in such a way as to be fed according to the rotation of the spindle 210. Further, the insulated electric wire 10 is hooked on the notch 91 of the winding frame 70 for the aligned multilayer wound coil to be fixed thereto.

In this state, while the spindle 210 is rotated in one direction, the guide 220 is caused to undergo parallel translation in association with rotation of the spindle 210 at a speed for enabling aligned winding, as shown in FIG. 3 (2), and FIG. 3 (3), thereby executing winding in a first layer. Upon completion of winding up to one of the sidewalls of the winding frame 70 for the aligned multilayer wound coil in this way, rotation at the driver is suspended, as shown in FIG. 3 (4), and the insulated electric wire 10 is guided out through the notch 82 of the sidewall of the winding frame 70 for the aligned multilayer wound coil, whereupon the insulated electric wire 10 is folded back at the protrusion 80.

With the insulated electric wire 10 in a state shown in FIG. 3 (5), the guide 220 is moved back to the original position thereof. After return of the guide 220, the insulated electric wire 10 is hooked on the notch 91 of the winding frame 70 for the aligned multilayer wound coil to be fixed thereto. Thereafter, while the spindle 210 is rotated in one direction, the guide 220 is caused to undergo parallel translation in association with the rotation of the spindle 210 at the speed for enabling aligned winding, as shown in FIG. 3 (6), FIG. 3 (7), thereby executing winding in a second layer. Upon completion of winding up to one of the sidewalls of the winding frame 70 for the aligned multilayer wound coil, in this way, the rotation at the driver is suspended, as shown in FIG. 3 (8), and the insulated electric wire 10 is guided out through the notch 82 of the sidewall of the winding frame 70 for the aligned multilayer wound coil.

Such an operation is repeated, thereby executing winding in a third layer (refer to FIG. 3 (9)), and thereafter, winding is continued up to the necessary number of layers. After the adjacent insulated electric wires 10 are stuck to each other, following the winding, the winding frame for the aligned multilayer wound coil is removed. For the insulated electric wire 10, an auto-fusion electric wire is preferably used. After removal of the winding frame, insulation between the insulated electric wires, provided across the respective winding layers, is removed, thereby connecting the wires in parallel with each other. More specifically, parallel connection lines 30, 40 are provided, and are connected to terminals 50, 60, respectively.

With the aligned multilayer wound coil having such a configuration as described above, when an insulated electric wire having a circular cross-section, easily available in the market, is used and the insulated electric wires are connected in parallel with each other, it is possible to provide a compact coil without the use of a flat-type electric wire that is expensive and low in marketability if an electric wire of an adequate size and an adequate number of layers are selected. Further, since a surface area larger than that in the case of using the flat-type electric wire can be secured, it is possible to mitigate a problem of the skin effect posing a problem when there is the need for flowing a high frequency current.

Furthermore, since windings in alignment are adopted, a voltage applied to each of the adjacent windings in one layer is equivalent to a voltage obtained by dividing a voltage applied across the parallel-connected coils by the number of windings in one layer. Further, a voltage applied to each of the adjacent windings is nearly zero in value. This is because those layers are connected in parallel with each other.

Thus, it is possible to provide a compact aligned multilayer wound coil having excellent insulation properties and a large current capacity by use of the insulated electric wire, generally called the magnet wire, without use of a specialized flat-type wire and without causing poor insulation, such as rare shorts or the like.

Second Embodiment

Figure 4:
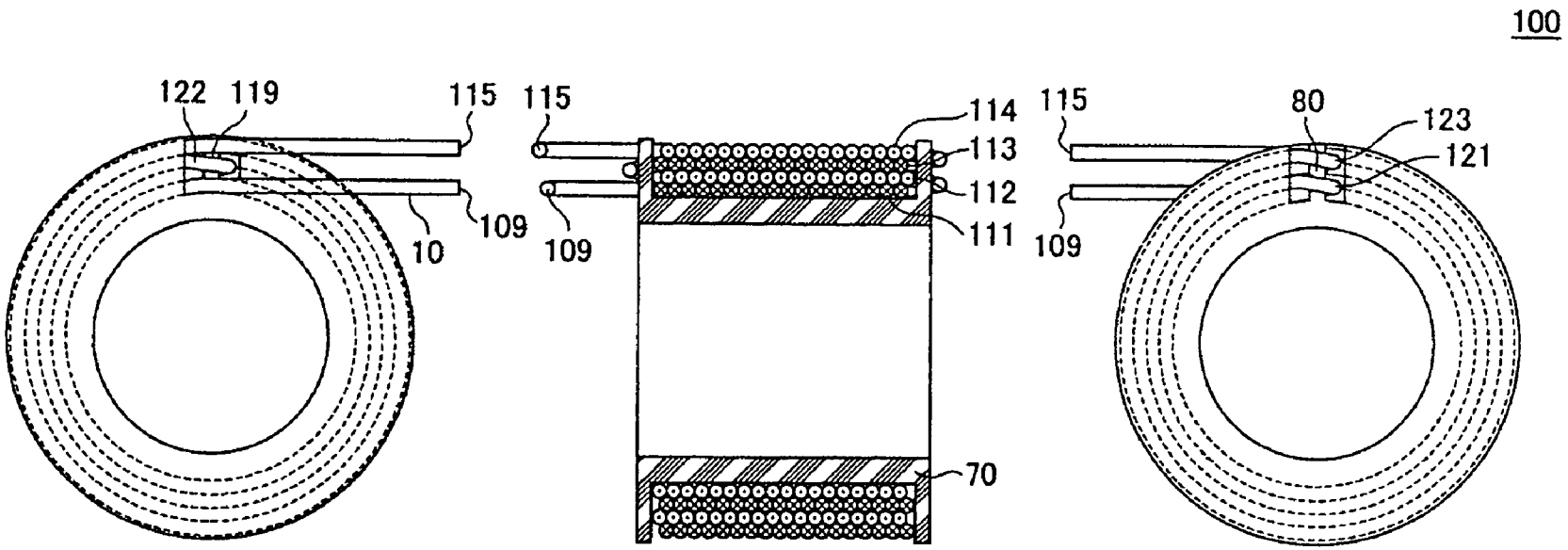
FIG. 4 is a view showing three planes of a series-connected aligned multilayer wound coil according to another embodiment of the invention.

A second embodiment of the invention is concerned with a continuously-wound aligned multilayer wound coil. As shown in FIG. 4, a coil 100 is an aligned multilayer wound coil comprising two or more winding layers, the winding layers being provided with insulated electric wires 10, respectively wound in alignment with each other, wherein a wire is folded back at a protrusion 80 of a bobbin end to be wound in a reverse direction, thereby continuously winding the wire in multiple layers without cutting. FIG. 4 is a view showing three planes of a series-connected aligned multilayer wound coil according to another embodiment of the invention.

As shown in FIG. 4, the series-connected aligned multilayer wound coil 100 according to the invention is an aligned multilayer wound coil comprising two or more winding layers, the winding layers being provided with the insulated electric wires 10 wound from a winding-start terminal 109 in alignment and a winding direction of each odd number layer (for example, layers 111, 113) of the aligned wound coils is opposed to that of each even number layer (for example, layers 112, 114) of the aligned wound coils.

The outer periphery of a position of an end of winding in the odd number layer of the aligned wound coils corresponds to a position of a start of winding in the even number layer of the aligned wound coils and when winding in an odd number layer is further provided on the outer periphery of the even number layer, the outer periphery of a position of an end of winding in the even number layer of the aligned wound coils corresponds to a position of a start of winding in an odd number layer of the aligned wound coils.

With an example shown in FIG. 4, the insulated electric wire 10, having circular cross-section, is wound on the winding frame 70 for the aligned multilayer wound coil shown in FIG. 2. A sidewall of the winding frame 70 for the aligned multilayer wound coil, on one side thereof, is provided with notches 81, 82 for enabling the insulated electric wire 10 to pass therethrough, respectively, and between the notches 81, 82 there is provided a protrusion 80 for enabling the insulated electric wire 10 to be turned around it. Similarly, a sidewall of the winding frame 70, on the other side, is provided with notches 91, 92 for enabling the insulated electric wire 10 to pass therethrough, respectively, and between the notches 91, 92, there is provided a protrusion 90 for enabling the insulated electric wire 10 to be turned around it, as shown in FIG. 2. If the winding frame 70 for the aligned multilayer wound coil, after winding, is put to use as a finished product, the winding frame 70 is preferably fabricated of an insulating material. Otherwise, the winding frame 70 may be fabricated of a metal instead of the insulating material to be removed out of the aligned multilayer wound coil after completion of winding.

The winding frame 70 for the aligned multilayer wound coil is wound with the insulated electric wirer 10 in alignment, as described above. A specific method for winding is described hereinafter with reference to FIG. 5. An apparatus 200 for manufacturing the aligned multilayer wound coil according to the invention, comprises a driver (not shown) capable of rotating a spindle 210 in a reverse direction, a controller (not shown), and a guide 220 for use in feeding of the insulated electric wire 10.

Figure 5:
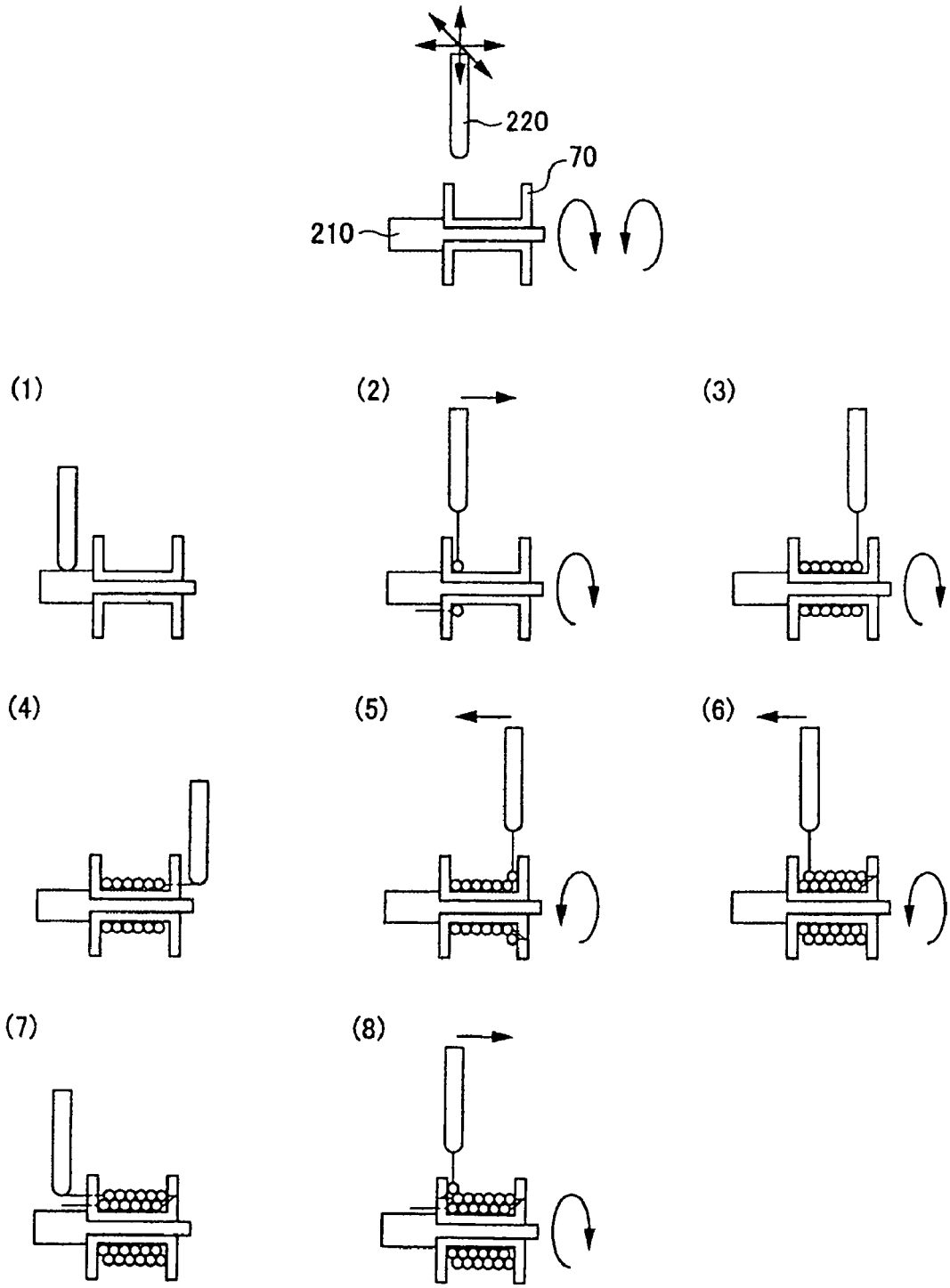
FIG. 5 is a conceptual view showing operation of an apparatus for manufacturing the aligned multilayer wound coil shown in FIG. 4.

The winding frame 70 for the aligned multilayer wound coil is set to a state shown in FIG. 5 (1) at the spindle 210 and the insulated electric wire 10 that is about to be used is set to the guide 220 in such a way as to be fed according to the rotation of the spindle 210. Further, the insulated electric wire 10 is hooked on the notch 91 of the winding frame 70 for the aligned multilayer wound coil to be fixed thereto.

In this state, while the spindle 210 is rotated in one direction, the guide 220 is caused to undergo parallel translation in association with rotation of the spindle 210 at a speed for enabling aligned winding as shown in FIG. 5 (2) and FIG. 5 (3), thereby executing winding in a first layer 111. Upon completion of winding up to one of the sidewalls of the winding frame 70 for the aligned multilayer wound coil in this way, rotation of the driver is suspended, as shown in FIG. 5 (4), and the insulated electric wire 10 is guided outside through the notch 82 of the sidewall of the winding frame 70 for the aligned multilayer wound coil, the guide 220 being moved back inside the sidewall with the insulated electric wire 10 passing through the notch 81.

With the guide 220 in a moved-back state as shown in FIG. 5 (5), the spindle 210 is rotated in a reverse direction, as shown in the figure, and the guide 220 is caused to undergo parallel translation in a direction opposed to that of the first layer 111, in association with the rotation of the spindle 210, at the speed for enabling aligned winding (FIG. 5 (6)). Upon completion of winding in a second layer 112 up to the sidewall, the insulated electric wire 10 is guided outside through the notch 92 of the sidewall of the winding frame 70 for the aligned multilayer wound coil, and the guide 220 is moved back inside the sidewall with the insulated electric wire 10 passing through the notch 91 (FIG. 5 (7), 5 ((8)).

With the guide 220 in a moved-back state as shown in FIG. 5 (8), the spindle 210 is rotated in a direction reverse to the case of the second layer 112, and the guide 220 is caused to undergo parallel translation in a direction opposed to that in the case of the second layer 112, in association with the rotation of the spindle 210, at the speed for enabling aligned winding. Thus, winding in a third layer 113 is executed. Thereafter, winding in alignment is similarly executed in the respective odd number layers and the respective even number layers.

Upon completion of winding in a necessary number of the layers, as described in the foregoing, the insulated electric wire 10 is drawn out through the notch 91 to provide a terminal 115, whereupon the aligned multilayer wound coil 100, connected in series between the terminal 109 and the terminal 115, can be manufactured.

Since the aligned wound coils in the respective odd number layers are connected in series with the aligned wound coil in the respective even number layers, when both ends of those coils are connected to a power source, thereby causing a current to flow, a magnetic field generated by the current flowing through each of the coils in the respective odd number layers and a magnetic field generated by a current flowing through each of the coils in the respective even number layers are opposed to each other in direction, thereby cancelling each other out. Further, it is possible to effectively reduce the inductance to as small as nearly zero by adjusting the number of windings in a specific layer in order to adjust the inductance of the aligned wound coils. Thus, non-inductive resistance can be provided.

Figure 6:
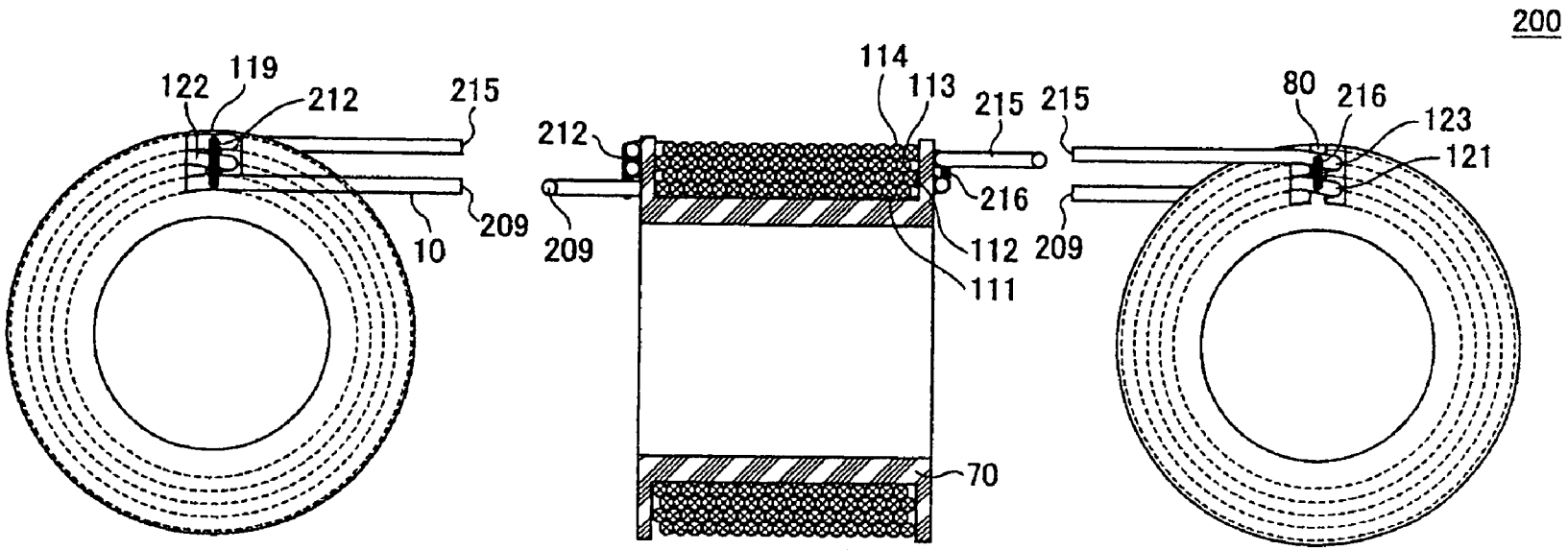
FIG. 6 is a view showing three planes of a parallel-connected aligned multilayer wound coil according to still another embodiment of the invention.

Further, as shown in FIG. 6, if crossover parts (119, 122) guided out to respective ends of the coils from the winding frame 70 are joined together at a solder 212, and so forth, for connection with one terminal 209 while crossover parts (121, 123) guided out from the other ends of the coils are joined together at a solder 216, and so forth, for connection with the other terminal 215, and the coils in respective layers are used so as to be in parallel with each other, those coils can be used as the aligned multilayer wound coil.

An embodiment of the invention for use as a voice coil of a speaker

Figure 7:
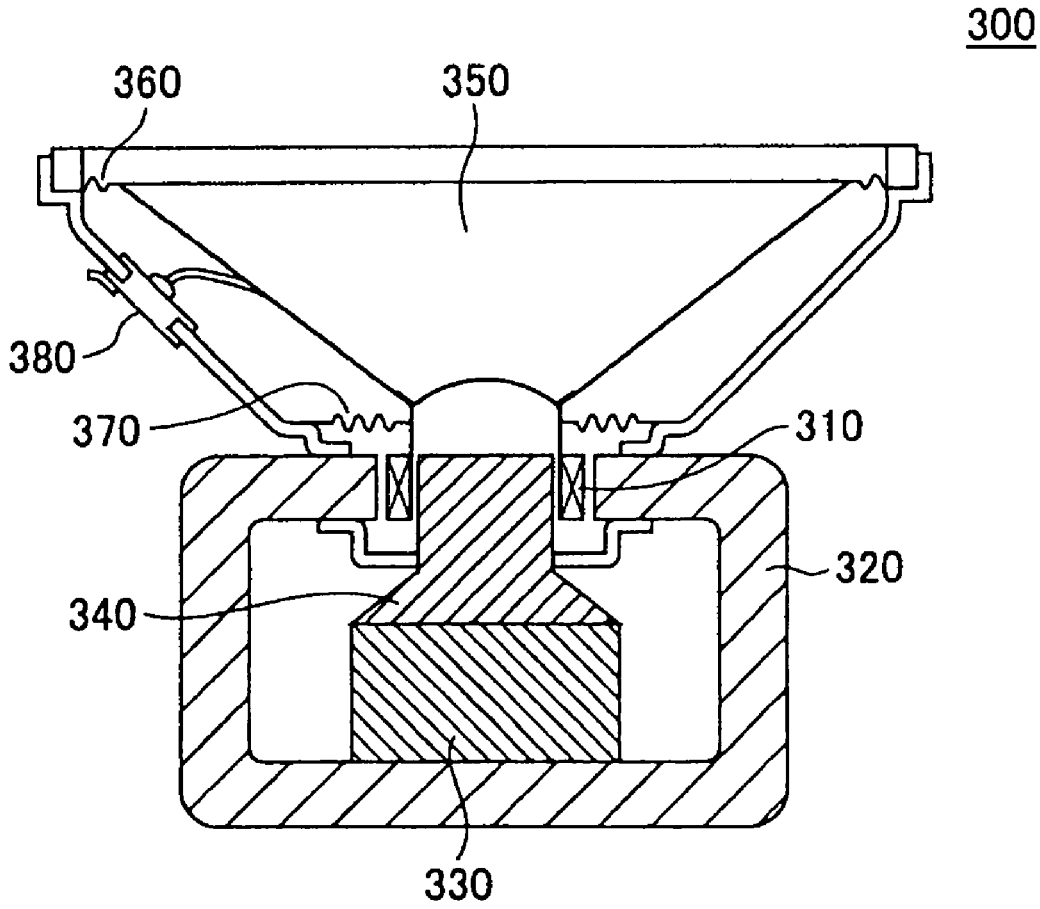
FIG. 7 is a view showing a structure of a common electrokinetic direct-radiator speaker.
Figure 8A:
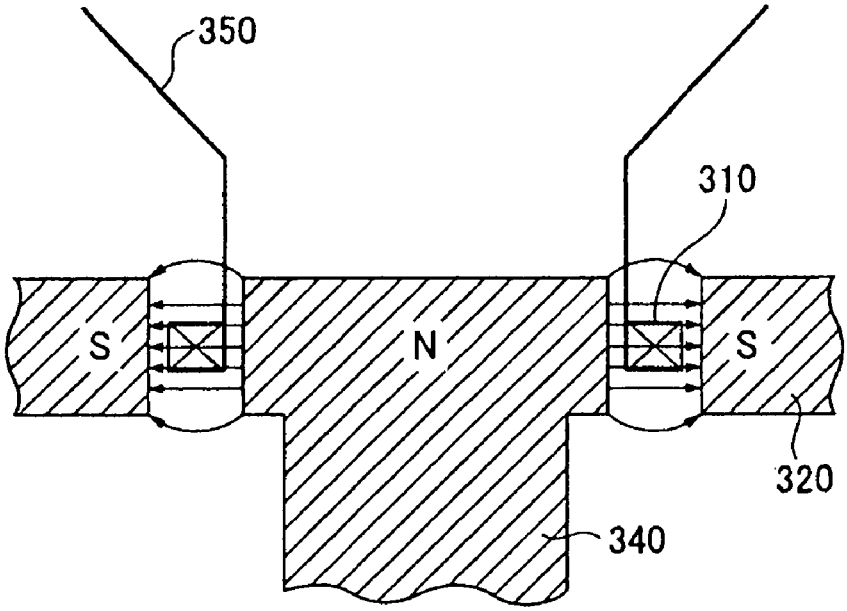
FIGS. 8 (A), 8(B) each are a view showing relationship between a coil width and nonlinear distortion.
Figure 8B:
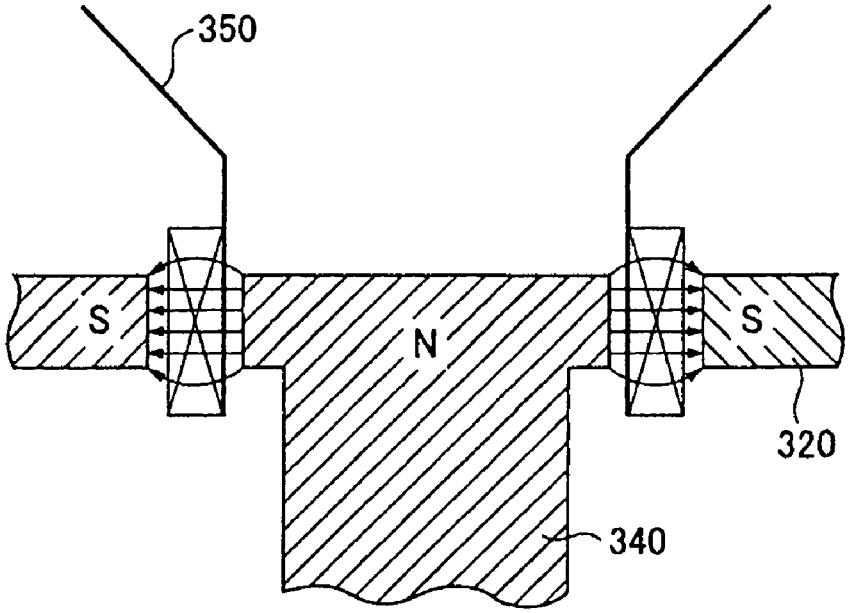
Figure 9:
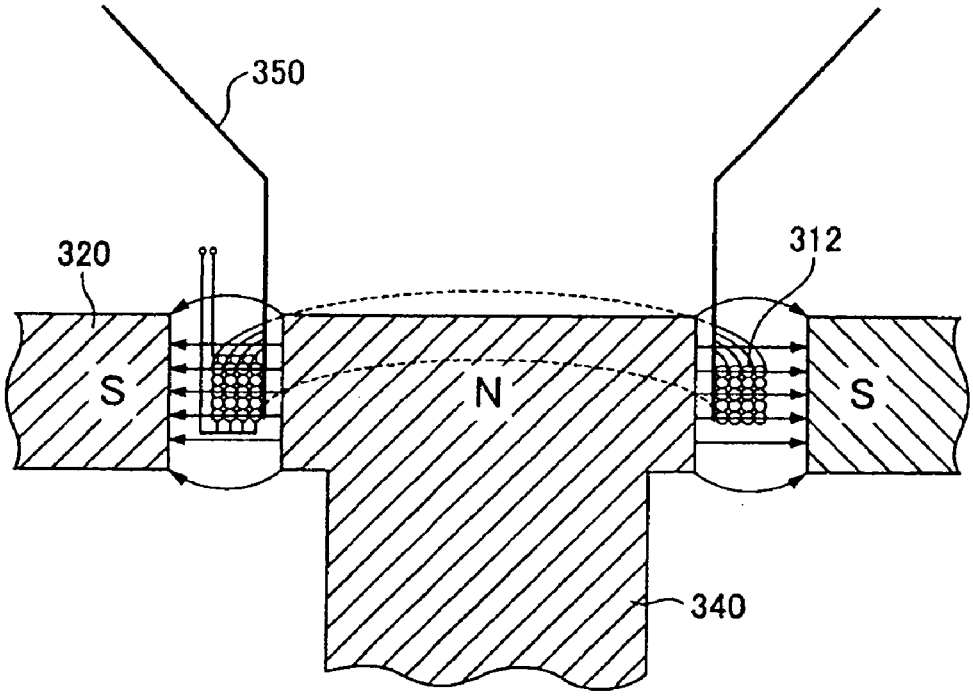
FIG. 9 is a view showing an embodiment of the parallel-connected aligned multilayer wound coil according to the invention for use as a voice coil of a speaker.

There will be described hereinafter the parallel-connected aligned multilayer wound coil according to the invention, used as a voice coil of a speaker and representing a suitable embodiment of the invention. FIG. 7 shows a structure of a common electrokinetic direct-radiator speaker. FIG. 8 is a view showing a relationship between a coil width and non-linear distortion. FIG. 9 is a view showing an embodiment of the parallel-connected aligned multilayer wound coil according to the invention, for use as the voice coil of a speaker.

In FIG. 7, a common electrokinetic direct-radiator speaker 300 comprises a voice coil 310, a yoke 320, a permanent magnet 330, a center magnet 340, a cone 350, an edge 360, a center support 370, and a terminal 380. A magnetic field between the yoke 320, and the center magnet 340 is produced by the permanent magnet 330. Upon application of a signal voltage amplified by an amplifier from the terminal 380, a current flows through the voice coil 310. By the agency of the current flowing through the voice coil 310, and the magnetic field produced between the yoke 320 and the center magnet 340, an electromagnetic force is generated, thereby causing the cone 350 to vibrate. A voice propagates in air due to the vibration of the cone 350.

The magnetic field produced between the yoke 320 and the center magnet 340 is substantially uniform at the central region thereof, as shown in FIG. 8, but is non-uniform in end regions thereof. If the voice coil 310 is large in width, the voice coil 310 will operate across the end regions where the magnetic field is non-uniform, as shown in FIG. 8 (B). For this reason, the voice coil 310 is susceptible to the occurrence of nonlinear distortion. Accordingly, with a high-end speaker, a flat-type electric wire has been adopted and a voice coil small in width, as shown in FIG. 8 (A), has been used.

In the case of a voice coil 312 based on the parallel-connected aligned multilayer wound coil according to the present invention, using an insulated electric wire having a circular cross section, easily available in the market, as shown in FIG. 9, the voice coil 312 can be put to practical use without the use of a flat-type electric wire that is expensive and low in marketability by selecting an adequate size of the insulated electric wire and an adequate number of layers if used in parallel. Further, since it is possible to provide a larger surface area in this case as compared with the case of using the flat-type electric wire, a problem of the skin effect can be reduced, thereby contributing to reproduction of a high frequency voice.

Embodiment of the invention, for use as a transformer

Now, there is described hereinafter an example where the invention is applied to a high voltage transformer for use in an HID lamp (High-Intensity Discharge Lamp) as a representative example of the coil according to the invention, used as a transformer coil. The HID lamp includes a mercury lamp, metal halide lamp, high pressure sodium lamp, and so forth. Since the metal halide lamp is excellent in color rendering properties, and high in luminous efficiency above all, it has often been used for automobile lighting. With the HID lamp, a high voltage not lower than 2 kV is required to enable the start of discharge. Further, there is the need for use of a coil having a thickness to a certain extent because a large current flows upon the start of the discharge, although for a brief period of time. Furthermore, with an automobile, since the HID lamp needs to be fitted into a region crowded with other components, such as an engine room, and so forth, there has been the necessity of reducing the volume thereof. For this reason, a flat-type electric wire has thus far been used for the coil of the high voltage transformer.

Figure 10:
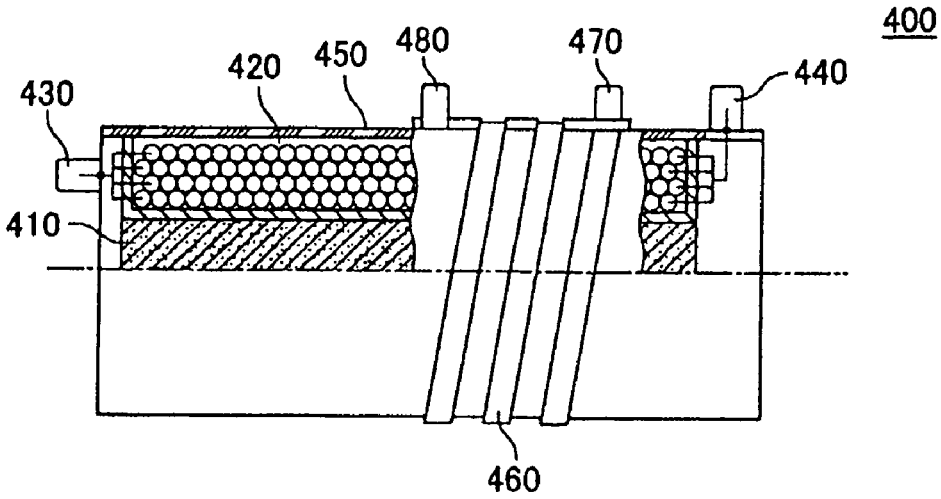
FIG. 10 is a view showing a high voltage transformer employing the parallel-connected aligned multilayer wound coil according to the invention.

FIG. 10 shows a high voltage transformer for the HID lamp employing the parallel-connected aligned multilayer wound coil according to the present invention. As shown in FIG. 10, with a high voltage transformer 400 for the HID lamp, the parallel-connected aligned multilayer wound coil 420 as a high voltage coil is wound around a ferrite core 410. As shown in the figure, an aligned multilayer wound coil 420 comprises four layers and the respective layers are connected in parallel with each other to be connected between terminals 430 and 440. An insulator 450 is provided on the top of the aligned multilayer wound coil 420 and a low-voltage side coil 460, the low-voltage side coil 460, using a flat-type electric wire, is wound around on the outer side of the insulator 450.

Thus, it is possible to realize a coil structure high in reliability by use of a round wire having marketability, such as a magnet wire, and so forth, although with the coil structure, there has been use of a specialized flat-type wire that is expensive and poor in productivity, in order to reduce a potential difference occurring between adjacent wires.

Embodiment for Providing Non-Inductive Resistance

As described in the foregoing, if the aligned wound coils in the respective layers are connected in series with each other, the magnetic fields generated in the respective layers cancel each other out so that a non-inductive resistance can be realized through series-connection. Inductance of a winding on the outer side slightly differs from inductance of a winding on the inner side. By adjusting the number of windings, in some layers, for correction of such difference, it is possible to realize a non-inductive resistance with an inductance substantially close to zero.

Third Embodiment

Figure 11:
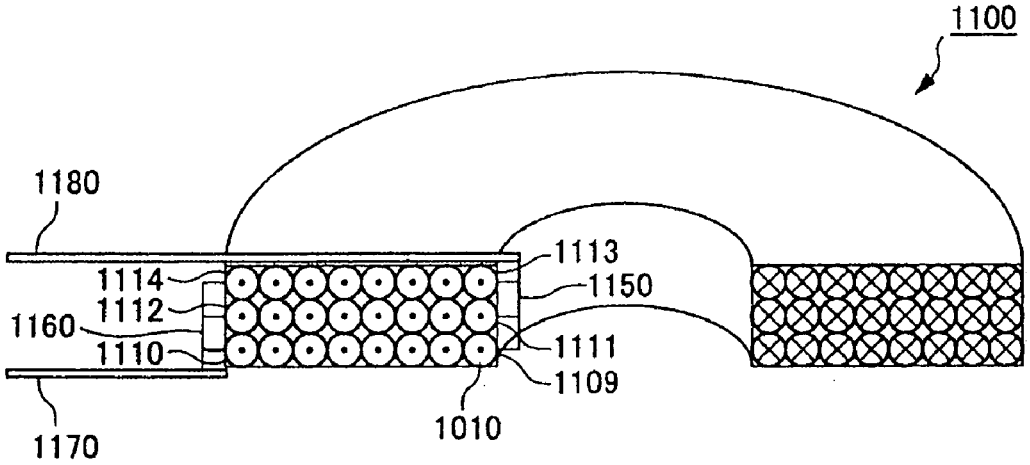
FIG. 11 is a view showing an aligned wound multilayer coil according to a further embodiment of the invention comprising winding layers, the winding layers each being provided with insulated electric wires wound in alignment with each other in the radial direction of the coil.

A third embodiment of the invention is concerned with an aligned wound multilayer coil comprising two or more winding layers, the winding layers each being provided with insulated electric wires wound in alignment with each other in the radial direction of the coil, as shown in FIG. 11.

As shown in FIG. 11, an aligned wound multilayer coil 1100 comprises the two or more winding layers, the winding layers each being provided with insulated electric wires 1010 wound in alignment with each other in the radial direction of the coil. To describe in more detail, the insulated electric wire 1010 is wound from a winding-start point in alignment in the radial direction up to a winding-completion point, thereby forming a first winding layer. Then, a lead wire 1109 is guided out from an inner peripheral part of the first winding layer, and a lead wire 1110 is guided out from an outer peripheral part of the first winding layer.

Similarly, an insulated electric wire 1010 is wound from a winding-start point in alignment in the radial direction up to a winding-completion point, thereby forming a second winding layer. Then, a lead wire 1111 is guided out from an inner peripheral part of the second winding layer and a lead wire 1112 is guided out from an outer peripheral part of the second winding layer. Similarly, a third winding layer is formed and a lead wire 1113 is guided out from an inner peripheral part of the third winding layer, and a lead wire 1114 is guided out from an outer peripheral part of the third winding layer.

Those winding layers described above are formed so as to conform to the specification required of the aligned wound multilayer coil 1100 to be adjoined and stuck to each other. Further, the lead wires 1110, 1112, 1114 for the respective layers, guided out from the respective outer peripheral parts, are connected to one terminal 1170 via a connection line 1160 while the lead wires 1109, 1111, 1113 for the respective layers, guided out from the respective inner peripheral parts, are connected to the other terminal 1180 via a connection line 1150.

With the aligned wound multilayer coil 1100 having such a configuration as described, it is possible to provide a coil compact in size, and flat in profile by using an insulated electric wire having a circular cross-section, easily available in the market, and by selecting the number of the winding layers so as to conform to the specification as required without the use of a flat-type electric wire that is expensive and low in marketability. Further, since a surface area larger than that in the case of using the flat-type electric wire can be secured, it is possible to mitigate the problem of the skin effect posing a problem when there is the need for flowing a high frequency current.

Furthermore, since windings in alignment are adopted, a voltage applied to individual windings adjacent to each other in one layer is equivalent to a voltage obtained by dividing a voltage applied across the parallel-connected coil by the number of the windings in one layer. Further, a voltage applied to the individual windings adjacent to each other is nearly zero in value. This is because those layers are connected in parallel with each other.

Thus, it is possible to provide an aligned multilayer wound coil that is compact in size, flat in profile, and excellent in insulation properties, capable of preventing poor insulation, such as rare shorts or the like, and having a large current capacity, by use of the insulated electric wire, generally called the magnet wire, without use of a specialized flat-type wire.

Fourth Embodiment

Figure 12:
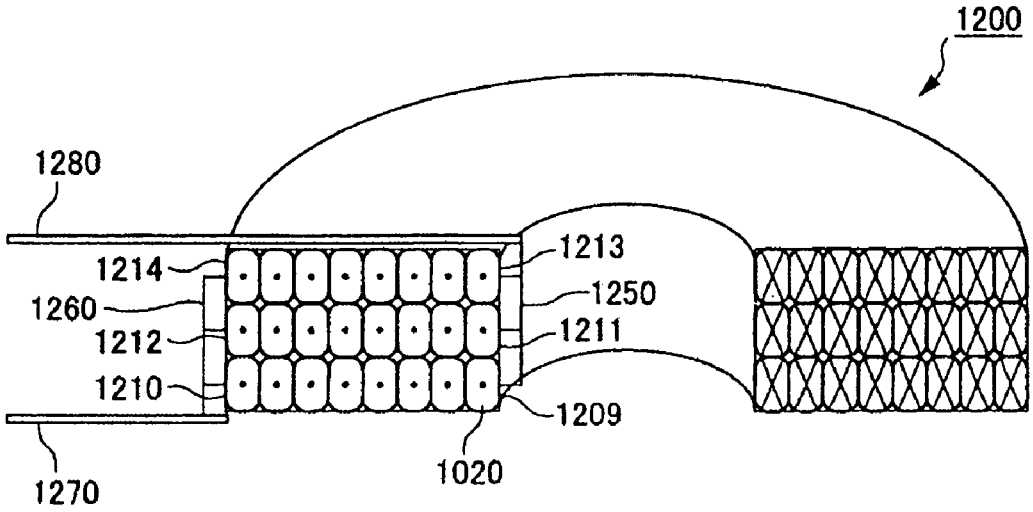
FIG. 12 is a view showing an aligned wound multilayer coil according to a further embodiment of the invention comprising winding layers, the winding layers each being provided with flat-type wires wound in alignment in the radial direction of the coil.
Figure 13:
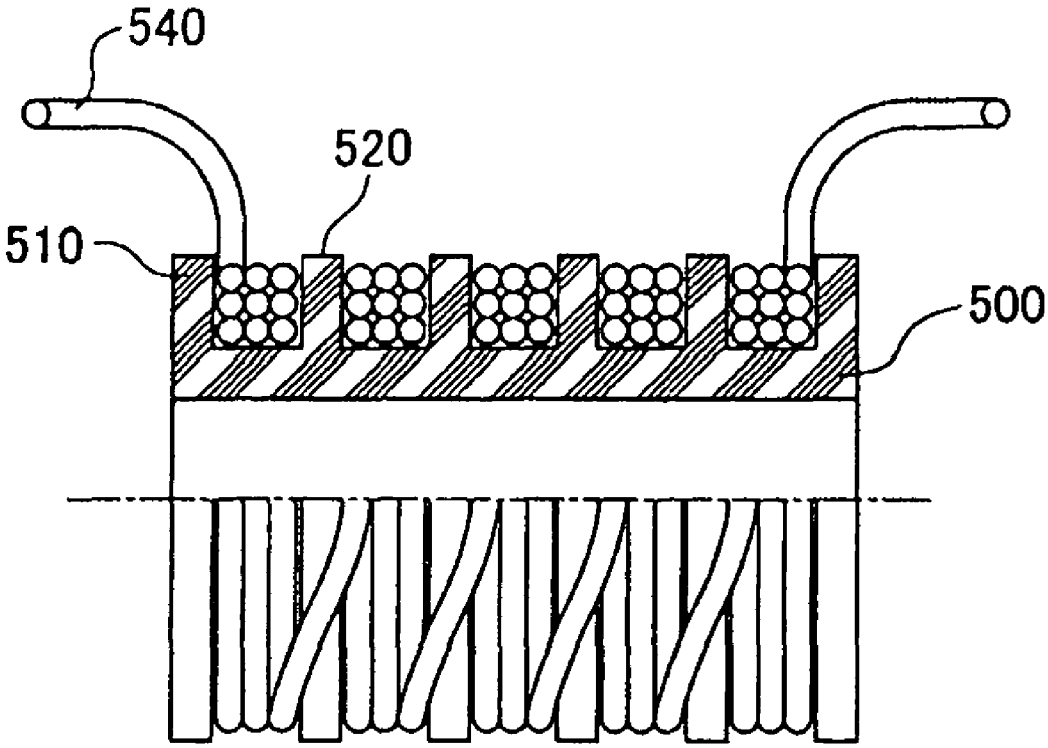
FIG. 13 is view showing a high-voltage wound coil.

As shown in FIG. 12, an aligned wound multilayer coil 1200 comprises two or more winding layers, the winding layers each being provided with flat-type wires 1020 wound in alignment in the radial direction of the coil. For the flat-type wire 1020, use can be made of, for example, an NA ribbon wire manufactured by Tokyo Special Electric Wire Co., Ltd. More specifically, the flat-type wire 1020 is wound from a winding-start point in alignment in the radial direction up to a winding-completion point, thereby forming a first winding layer. Then, a lead wire 1209 is guided out from an inner peripheral part of the first winding layer while a lead wire 1210 is guided out from an outer peripheral part of the first winding layer.

Similarly, a flat-type wire 1020 is wound from a winding-start point in alignment in the radial direction up to a winding-completion point, thereby forming a second winding layer. Then, a lead wire 1211 is guided out from an inner peripheral part of the second winding layer and a lead wire 1212 is guided out from an outer peripheral part of the second winding layer. Similarly, a third winding layer is formed and a lead wire 1213 is guided out from an inner peripheral part of the third winding layer, and a lead wire 1214 is guided out from an outer peripheral part of the third winding layer.

Those winding layer described as above are formed so as to conform to the specification required of the aligned wound multilayer coil 1200 to be adjoined and stuck to each other. Further, the lead wires 1210, 1212, 1214 for the respective layers, guided out from the respective outer peripheral parts, are connected to one terminal 1270 via a connection line 1260 while the lead wires 1209, 1211, 1213 for the respective layers, guided out from the respective inner peripheral parts, are connected to the other terminal 1280 via a connection line 1250.

With the aligned wound multilayer coil 1200 having such a configuration as described, because windings in alignment are adopted, a voltage applied to individual windings adjacent to each other in one layer, is equivalent to a voltage obtained by dividing a voltage applied across the parallel-connected coil by the number of the windings in one layer. Further, a voltage applied to the individual windings adjacent to each other is nearly zero in value. This is because those layers are connected in parallel.

Having described the embodiments of the present invention as above, it is to be understood that the technical scope of the present invention is not limited to the scope of the description of the embodiments and that various changes and modifications may be made to those embodiments. Obviously, such changes and modifications are intended to be within the scope of the present invention and the appended claims. For example, as for the electrical equipment, description mainly in connection with the speaker and the high voltage transformer has been given, however, the present invention may be applied to a sensor coil and a motor. Further, an insulated electric wire having a circular cross-section has been mainly described, however, an insulated electric wire elliptical in cross-section may also be adopted for the present invention.

The invention claimed is:

1. An aligned multilayer-wound coil comprising two or more winding layers, the winding layers being provided with insulated electric wires, respectively, wound in one direction in alignment with each other, wherein a lead wire is guided out from respective ends of said coil, on a layer-by-layer basis, to form terminals to selectively connect winding layer coils on a layer-by-layer basis in parallel or in series with each other in a circuit.

2. An aligned multilayer-wound coil comprising two or more winding layers, the winding layers being provided with insulated electric wires, respectively, wound in one direction in alignment with each other, wherein a lead wire is guided out from respective ends of said coil, on a layer-by-layer basis, to form terminals to selectively connect winding layer coils on a layer-by-layer basis in parallel or in series with each other in a circuit and the lead wires guided out from one end of said coil are connected to one terminal while the lead wires guided out from the other end of said coil are connected to the other terminal, thereby connecting the winding layer coils on a layer-by-layer basis in parallel with each other in the circuit.

3. The aligned multiplayer-wound coil according to claim 2, wherein the number of windings in a specific layer of the aligned multilayer-wound coil is adjusted to adjust the inductance of the aligned multilayer-wound coil.

4. An aligned multilayer-wound coil comprising two or more winding layers, the winding layers being provided with insulated electric wires, respectively, wound in one direction in alignment with each other, wherein a lead wire is guided out from respective ends of said coil, on a layer-by-layer basis, to form terminals to selectively connect winding layer coils on a layer-by-layer basis in parallel or in series with each other in a circuit and the lead wires guided out from one end of said coil are connected to each other while the lead wires guided out from the other end of said coil are connected to each other, thereby connecting the winding layer coils on a layer-by-layer basis in series with each other in the circuit.

* * * * *